US009833654B1

(12) United States Patent
Gant et al.

(10) Patent No.: US 9,833,654 B1
(45) Date of Patent: Dec. 5, 2017

(54) HAND-HELD ADJUSTABLE EXERCISE APPARATUS

(71) Applicants: Clifford Ernest Gant, Lake Havasu City, AZ (US); Walter John Spawr, Lake Havasu City, AZ (US)

(72) Inventors: Clifford Ernest Gant, Lake Havasu City, AZ (US); Walter John Spawr, Lake Havasu City, AZ (US)

( * ) Notice: Subject to any disclaimer, the term of this patent is extended or adjusted under 35 U.S.C. 154(b) by 0 days.

(21) Appl. No.: 13/694,346

(22) Filed: Nov. 23, 2012

(51) Int. Cl.
*A63B 21/072* (2006.01)

(52) U.S. Cl.
CPC ..... *A63B 21/0724* (2013.01)

(58) Field of Classification Search
CPC ..... A63B 21/072; A63B 21/0724–21/0726; A63B 21/4047
USPC .... 482/44–50, 92–94, 97–98, 106–108, 139, 482/908
See application file for complete search history.

(56) References Cited

U.S. PATENT DOCUMENTS 4,274,628 A * 6/1981 Hoagland ..... A63B 21/0724 482/106
4,629,184 A * 12/1986 Selkee ..... 482/106
4,858,917 A * 8/1989 Montgomery ..... A63B 21/0602 482/106
4,863,158 A * 9/1989 Tassone ..... 482/140
4,901,999 A * 2/1990 Schott ..... 482/45
5,167,596 A 12/1992 Ferber
5,267,921 A 12/1993 Roehlk
5,505,681 A 4/1996 Bruggeman
5,836,858 A * 11/1998 Sharff ..... 482/106
5,941,799 A 8/1999 Bergdorf
5,976,059 A 11/1999 Brown
6,071,214 A 6/2000 Osterman
6,106,438 A 8/2000 Dean
6,773,377 B1 8/2004 Yu
7,056,268 B2 * 6/2006 Emick ..... A63B 21/0724 482/106
7,537,552 B2 5/2009 Dalebout

* cited by examiner

*Primary Examiner* — Loan H Thanh
*Assistant Examiner* — Jennifer M Deichl
(74) *Attorney, Agent, or Firm* — Venjuris, P.C.

(57) ABSTRACT

A single hand-held full body muscle building exercise apparatus, with a curved bar, that allows conventional disc shaped weights to be mounted on each end of the bar, with two handles located near the longitudinal center of the bar, that are adjustable, to allow for targeting specific muscle groups in the hands, arms, shoulders, chest, abdomen, back, buttocks, legs, ankles and feet. Each handle is adjustable to allow symmetrical and asymmetrical changes in gravitational load on each side of the user's body. The distance between each hand, and the rotational angles of the wrists, forearms, and shoulders can be changed while maintaining the center of gravity, of the weighted bar, about the center of gravity of the human body, during lower body and upper body exercises.

16 Claims, 7 Drawing Sheets

HAND-HELD ADJUSTABLE EXERCISE APPARATUS

FIELD OF INVENTION

An adjustable apparatus that is intended to be operated by a human user for the purpose of facilitating the conditioning or developing of a muscle or group of muscles of the user by repetitive or continuous activity of the user.

BACKGROUND AND SUMMARY OF INVENTION

Historically, many varieties of exercise devices have been available worldwide, intended to increase human body muscular strength. To obtain a full body work out protocol routine, the user must employ a variety of multiple exercise machines designed for a small quantity of specific muscle groups. This current invention is a single hand-held gravitational weighted device that allows for a full body workout protocol routine while allowing the user to select and isolate a large quantity of specific individual muscle groups. No prior art allows for such broad capabilities in a single hand-held device. Prior art devices employ torsional turning and twisting members, friction disc resistance devices, hydraulic devices, gravitational weighted devices, and spring loaded devices as disclosed in BERGDORF, U.S. Pat. No. 5,941,799 (Aug. 24, 1999); YU, U.S. Pat. No. 6,773,377 B1 (Aug. 10, 2004); BRUGGEMANN, U.S. Pat. No. 5,505,681 (Apr. 9, 1996). These prior art devices typically have handle(s) intended to be grasped by the hands of the user, in order to perform the required exercise maneuvers. Such a device is further disclosed by SCHOTT in U.S. Pat. No. 4,901,999. These devices are limited to resistive rotational exercise protocols that are limited to strengthening the hands, wrists and forearms, and do not consider the upper arms or shoulders, or weight bearing load enhancement, or full body enhancement. Similar devices utilizing handles are disclosed in FERBER, U.S. Pat. No. 5,167,596; BROWN, U.S. Pat. No. 5,976,059; OSTERMAN, U.S. Pat. No. 6,071,214; DEAN, U.S. Pat. No. 6,106,438; ROEHLK, U.S. Pat. No. 5,267,921, and also do not provide full body muscle strength development. More muscle groups can be exercised by use of a large floor mounted apparatus, which requires the user to sit or lay down on the device, as disclosed in DALEBOUT, U.S. Pat. No. 7,537,552 B2 (May 26, 2009), but is not hand-held and is massive complex mechanical device. The instant invention was developed to accomplish more effective exercise protocols, and speed muscle strength development, in multiple muscle groups, which cannot be accomplished with the prior art. As an example, a well-known muscle building protocol, which is one of many central elements to this invention, is termed the "curl". The "curl" is performed by placing both hands on a conventional dumbbell bar and curling the weighted bar up, to a horizontal position, by moving the forearms up, by bending the elbows, while maintaining the upper arms in a down vertical position. This repetitive exercise protocol produces gravitational load on the bicep muscles, and improves their strength level. The prior art "curl" apparatus' are primarily limited to bicep muscle strength building. With the instant invention, the handles are adjusted to allow specific changes in the distance, between the hands, and the rotational angles of the hands and forearms, relative to a vertical or horizontal plane.

Changes in the separation distance between hands, and rotational angular changes of the hands and forearms, allows the user of the device to select and isolate specific muscle groups, to his or her selection, to be worked, that are not available in prior art hand-held devices, as said prior art devices, do not allow isolation of muscle groups other than the bicep or forearm muscle group. Therefore, a full body workout protocol is not possible with prior art hand-held devices. An important feature of the instant invention is the curved shape of the bar that the handles are attached to. This curve shaped bar conforms to the human body shape, and surrounds the user, so that the center of gravity of the weighted bar is aligned with the user's center of gravity, thereby allowing both upper and lower body exercise protocol while the user is in a standing position. This advantageous feature will be recognized to those skilled in the art. For example, this instant invention identifies one single hand-held device that can be used to isolate and individually exercise muscles such as the: Abductor Policies Longus, Extensor Pollicis Brevis, First Dorsal Interosseous, Abductor Pollicis, Opponens Pollicis, Abductor Pollicis Brevis, Flexor Pollicis Longus, Flexor Digitorum Superficialis, Extensor Retinaculum, Extensor Pollicis Brevis (wrist and hand); Flexore Capri Ulnaris, Flexore Capri Radialis, Palmaris Longus, Extensor Capri Radialis Brevis, Extensor Capri Radialis Longus, Extensor Digiti Minimi, Extensor Carpi Ulnaris, Extensor Digitorum, Extensor Carpi Radialis Brevis (lower arm); Brachialis, Brachioradialis, Biceps Brachi, Triceps Brachi—Lateral Head, Long Head, Medial Head (upper arm); Anterior Deltoid, Posterior Deltoid, Middle Deltoid, Supraspinatus, Infraspinatus, Teres Minor (shoulder); Pectoris Major Clavicular Head, Pectoris Major Sternocostal Head, Pectoralis Major Abdominal Head (chest); Rhomboid Major, Rhomboid Minor, Latissimus Dorsi, Trapezius, Aponeurotic Insertion of Latissimus Dorsi, External Oblique, Lliocostalis, Spinalis Thoracis, Longissimus Thoracis, Serratus Posterior Inferior, Quadratus Lumborum (back); Rectus Abdominis, Internal Oblique (abdomen); Gluteus Maximus (buttocks); Lliopsoas, Pectineus, Abductor Longus, Gracilis, Sartorius, Rectus Femorus Quadricep, Vastus Lateralis Quadricep, Vastus Medialis Quadricep, Vastus Intermedius Quadricep, Gastrocnemius Medial Head and Lateral Head, Soleus, Peroneus Longus, Tibialis Anterior, Extensor Digitorum Longus, Peroneus Brevis, Flexor Digitorum Longus, Extensor Hallucis Longus, Peroneus Tertius, Lateral Malleolus, Extensor Retinaculum, Extensor Digitorum Brevis (lower legs, ankles and feet). No prior art, of a single hand-held device, can address all these muscle groups.

DETAILED DESCRIPTION OF THE INVENTION

Figure 1:
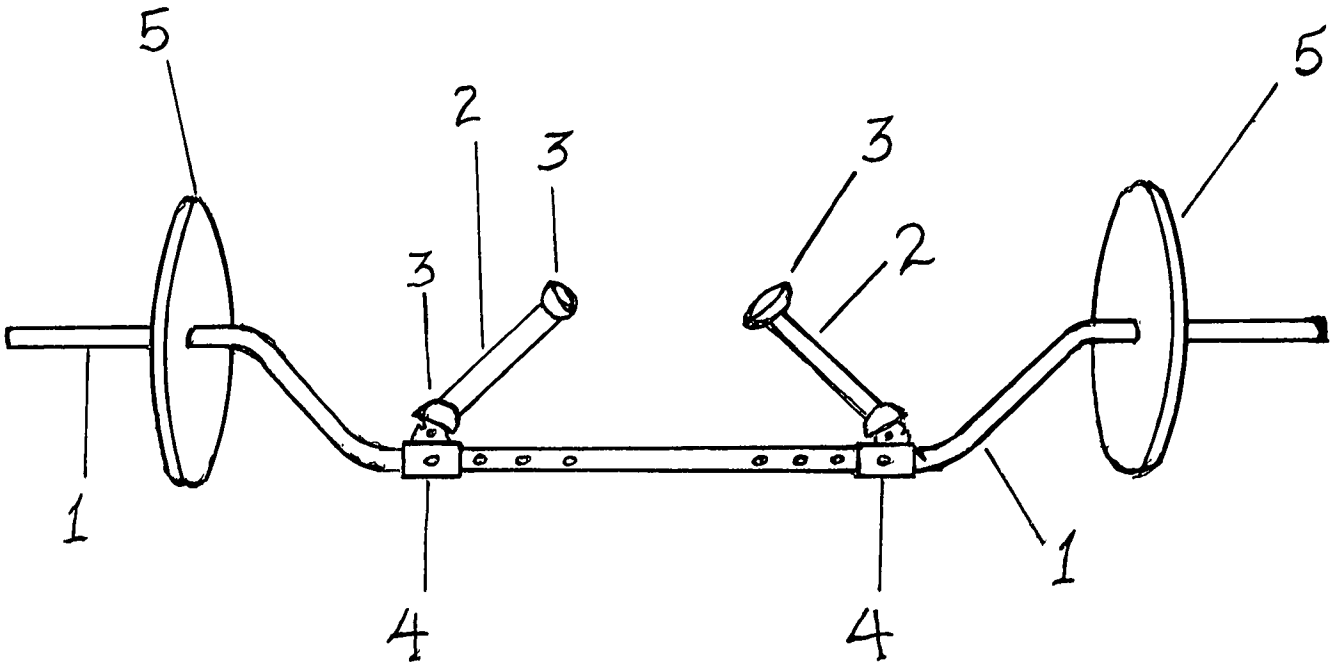
FIG. 1 is a view of the complete exercise apparatus.

FIG. 1 shows an exercise bar 1 provided with two identical handle members 2 at a separation distance between them. The separation distance can be adjusted by moving slide mechanism 4 either closer together or farther apart to accommodate the desires of the person using the device. Handles 2 may be tilted through a 90 degree arc to accommodate the desires of the user for isolating specific muscle groups to be concentrated on. The handles have bell shaped hemispherical cups 3 on each end to protect the user's hands and fingers from impact or abrasion injuries. Two wheel shaped discs 5 are located near the outside ends of the bar 1 to allow the exercise device to be set or positioned on a flat plane, or floor, and prevent any part or section of the bar 1 or handle 2 mechanisms from contracting the flat plane or floor.

Figure 2:
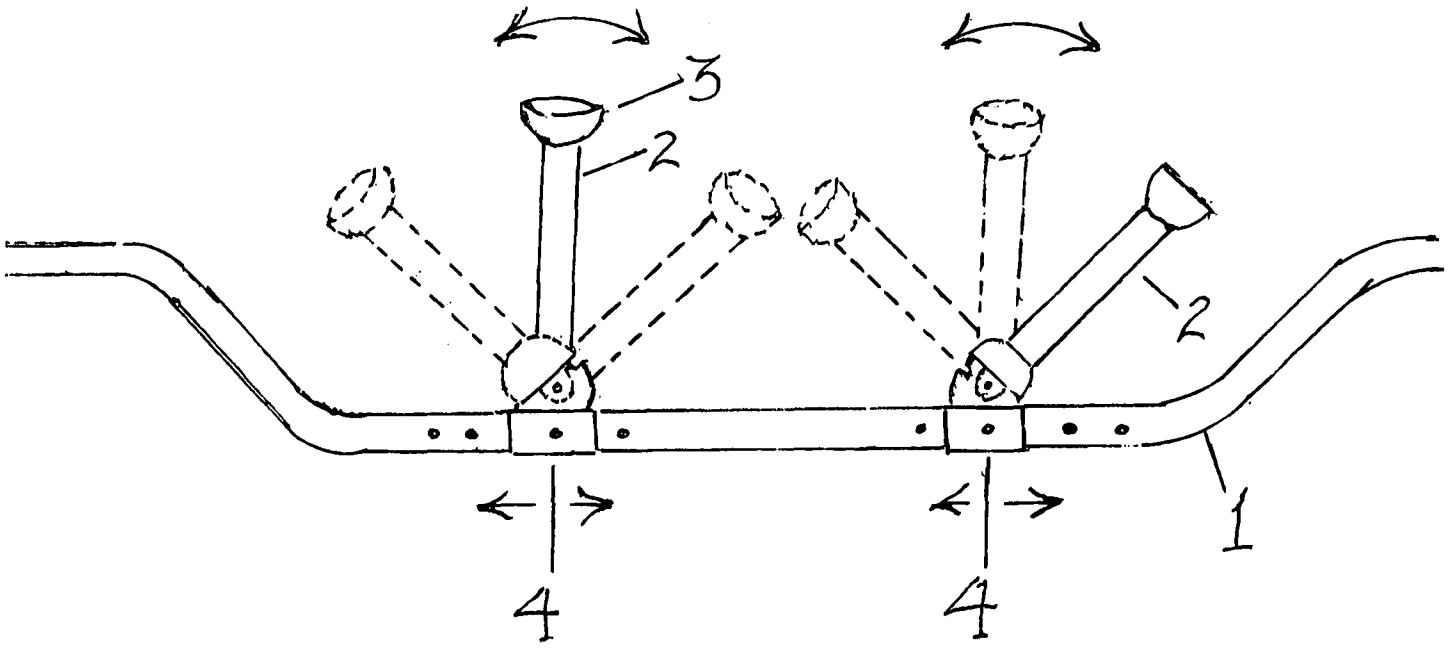
FIG. 2 is a view illustrating handle rotation and separation features.

FIG. 2 shows the handle 2 rotational or tilting features, and the ability to change the separation distance between handles 2 by moving slide mechanism 4.

Figure 3:
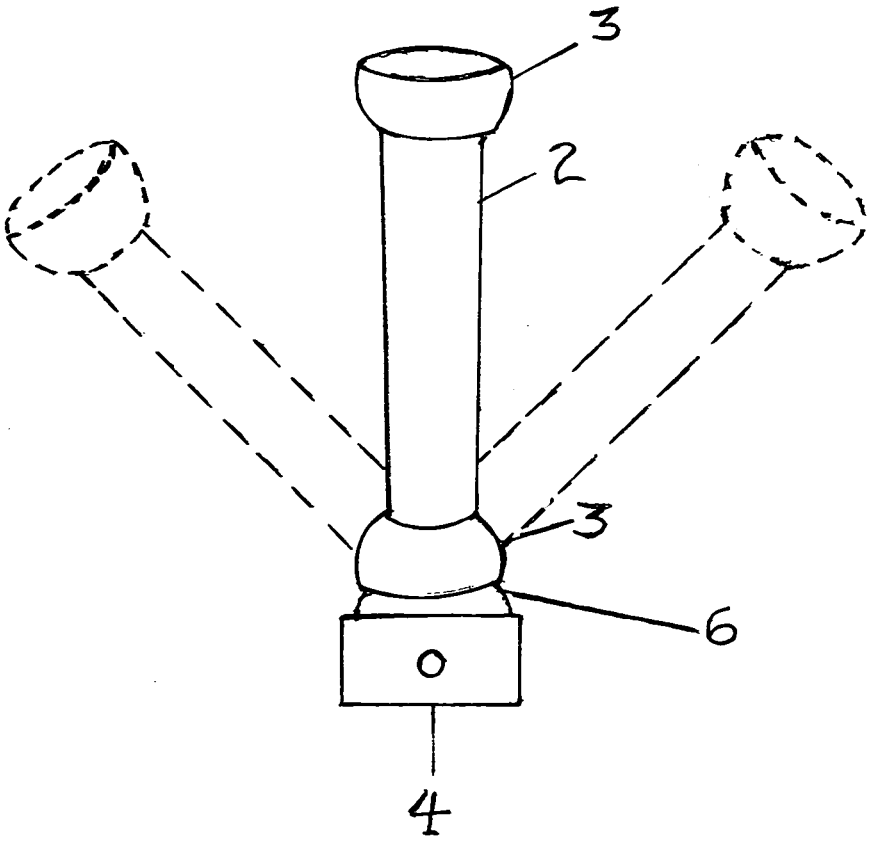
FIG. 3 is an enhanced view of the handle rotational feature.

FIG. 3 shows an enhanced view of the tilting capability of the handle(s) 2 relative to the slide mechanism 4 and handle locking pedestal 6.

Figure 4:
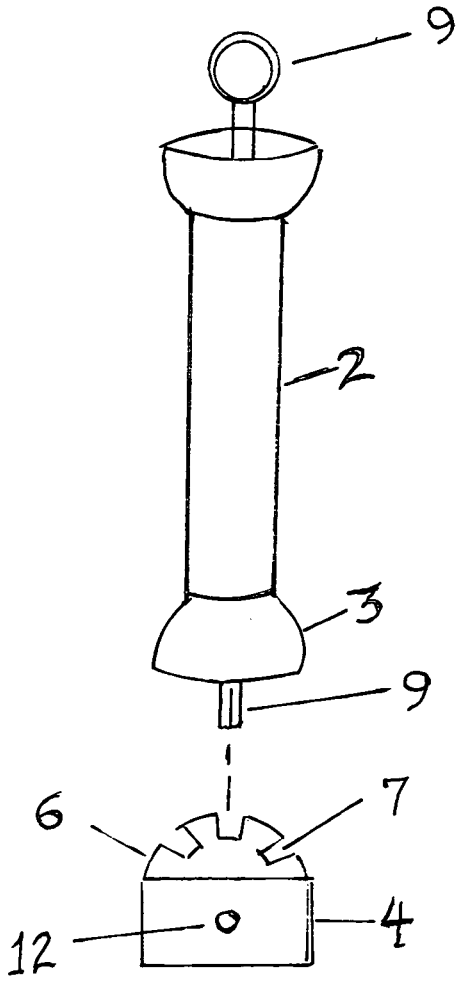
FIG. 4 is an exploded view of the handle assembly.

FIG. 4 shows an exploded view of the handle (2) interface feature with the slide mechanism 4 and locking pin 9 engagement into locking slot 7.

Figure 5:
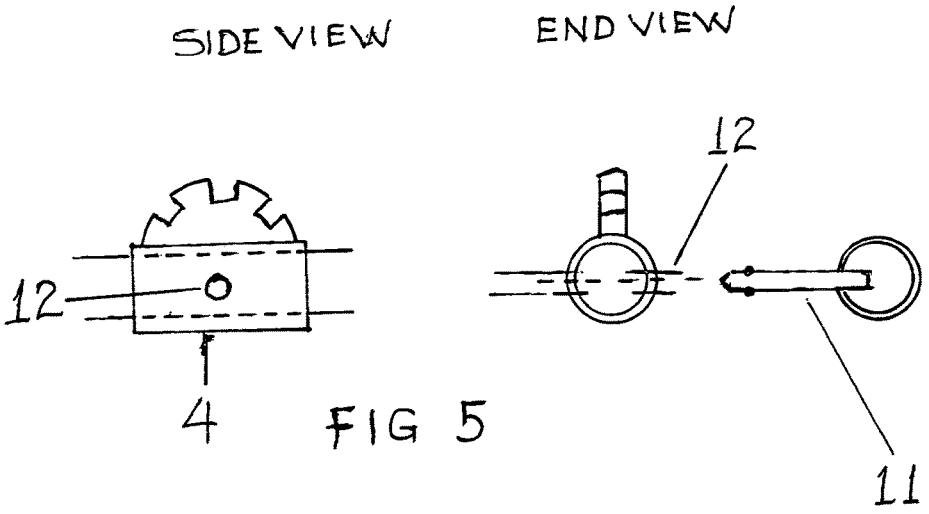
FIG. 5 is a 2-dimensional view of the handle spacing slid mechanism.

FIG. 5 shows the details of the slide mechanism 4 and clevis pin 11 that engages through hole 12.

Figure 6:
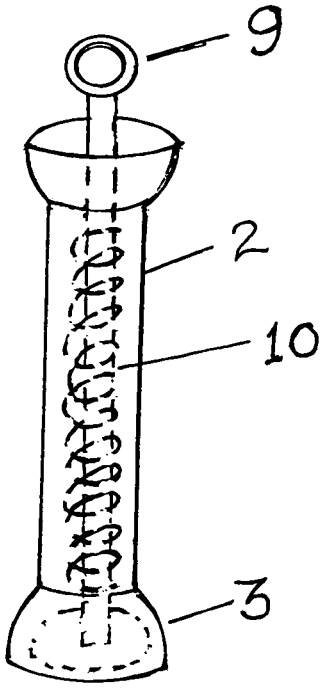
FIG. 6 is a view of the handle tilting locking mechanism.

FIG. 6 shows the details of the handle 2 tilting locking mechanism consisting of a locking pin 9 that is held in place under pressure from spring 10.

Figure 7:
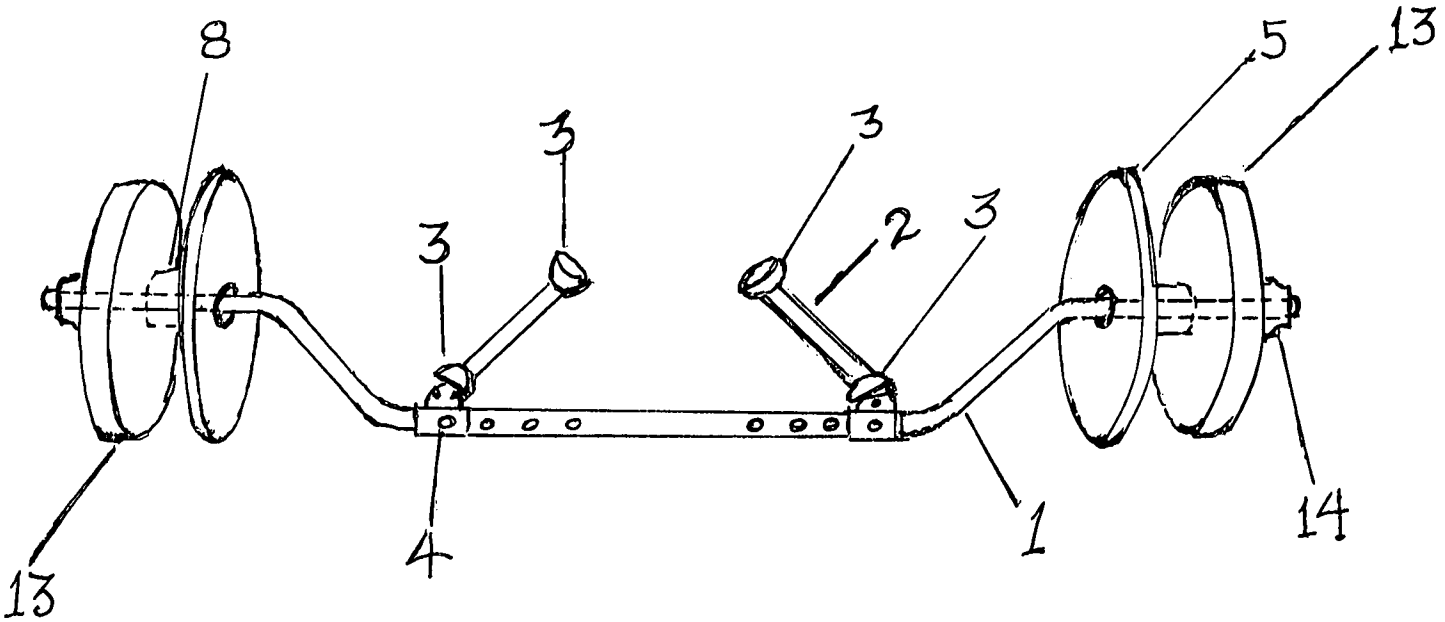
FIG. 7 is a view showing the placement of weights on the bar.

FIG. 7 shows the entire exercise device with optional weights 13 held in place by end coupling 14 and spacer 8.

What is claimed is:

1. A hand-held apparatus for exercising one or more muscles comprising:

(a) a bar comprising:

(i) two bar ends, each being substantially straight, extending along a first axis connecting the bar ends, and configured to couple to one or more weights, (ii) a central portion substantially straight and extending along a second axis parallel to and offset from the first axis, (iii) a first connecting portion configured to couple the central portion to a first one of the bar ends, and (iv) a second connecting portion configured to couple the central portion to a second one of the bar ends; and (b) two handles, each of the handles:

(i) comprising:

(1) a proximal end;

(2) a distal end;

(3) a longitudinal axis extending from the proximal end to the distal end, generally toward the first axis of the bar; and (4) a grip bar extending along the longitudinal axis, (ii) movably coupled to the central portion of the bar at the proximal end so that a distance between the handles is adjustable, and (iii) pivotally coupled to the central portion of the bar at the proximal end so that an angle between the second axis of the bar and the longitudinal axis of each handle is adjustable, wherein the two bar ends, the central portion, the first and second connecting portions, and the two handles are located in a common plane through a range of pivotal movement of the two handles.

2. The apparatus according to claim 1, wherein each of the handles is further configured to pivotally move up to plus or minus 45 degrees from a default position wherein a default angle between the longitudinal axis of each handle and the second axis of the bar is 90 degrees.

3. The apparatus according to claim 1, wherein the bar is further configured to conform with a body shape of a user by the first and second connecting portions curving along a left side and a right side of a body of the user, respectively, when at least one of the distal ends of the handles points to a general direction toward the user.

4. The apparatus according to claim 1 further comprises two supports coupled to the two bar ends respectively and configured to keep the bar and the handles above a surface on which the apparatus is placed.

5. The apparatus according to claim 1, wherein each of the handles further comprises a slide mechanism at the proximal end, the slide mechanism configured to movably engage with the bar and allow or disallow each handle to slide along the bar.

6. The apparatus according to claim 5, wherein the slide mechanism further comprises a pin configured to lock or unlock the slide mechanism by engaging or disengaging with one of one or more holes of the bar.

7. The apparatus according to claim 1, wherein the bar further comprises a weight locking mechanism coupled to one of the bar ends and configured to allow or disallow the one or more weights coupled to the one bar end to move relative to the bar.

8. A hand-held apparatus for exercising one or more muscles comprising:

(a) a bar comprising:

(i) two bar ends, each being substantially straight, extending along a first axis connecting the bar ends, and configured to couple to one or more weights, (ii) a central portion substantially straight and extending along a second axis parallel to and offset from the first axis, (iii) a first connecting portion configured to couple the central portion to a first one of the bar ends, and (iv) a second connecting portion configured to couple the central portion to a second one of the bar ends; and (b) two handles, each of the handles:

(i) comprising:

(1) a proximal end;

(2) a distal end;

(3) a longitudinal axis extending from the proximal end to the distal end, generally toward the first axis of the bar;

(4) a grip bar extending along the longitudinal axis; and (5) a tilting locking mechanism configured to allow or disallow each handle to pivotally move, (ii) movably coupled to the central portion of the bar at the proximal end so that a distance between the handles is adjustable, and (iii) pivotally coupled to the central portion of the bar at the proximal end so that an angle between the second axis of the bar and the longitudinal axis of each handle is adjustable, wherein the two bar ends, the central portion, the first and second connecting portions, and the two handles are located in a common plane through a range of pivotal movement of the two handles.

9. The apparatus according to claim 8, wherein the tilting locking mechanism is locked or unlocked depending on whether or not one of a plurality of slots of the tilting mechanism releasably receives a locking pin of the tilting locking mechanism.

10. The apparatus according to claim 9, wherein the tilting locking mechanism further comprises a coil spring coupled to the locking pin and configured to provide a compressive force along the longitudinal axis of each handle to the locking pin toward one of the slots.

11. The apparatus according to claim 8, wherein each of the handles is further configured to pivotally move up to plus or minus 45 degrees from a default position wherein a default angle between the longitudinal axis of each handle and the second axis of the bar is 90 degrees.

12. The apparatus according to claim 8, wherein the bar is further configured to conform with a body shape of a user by the first and second connecting portions curving along a left side and a right side of a body of the user, respectively, when at least one of the distal ends of the handles points to a general direction toward the user.

13. The apparatus according to claim 8 further comprises two supports coupled to the two bar ends respectively and configured to keep the bar and the handles above a surface on which the apparatus is placed.

14. The apparatus according to claim 8, wherein each of the handles further comprises a slide mechanism at the proximal end, the slide mechanism configured to movably engage with the bar and allow or disallow each handle to slide along the bar.

15. The apparatus according to claim 14, wherein the slide mechanism further comprises a pin configured to lock or unlock the slide mechanism by engaging or disengaging with one of one or more holes of the bar.

16. The apparatus according to claim 8, wherein the bar further comprises a weight locking mechanism coupled to one of the bar ends and configured to allow or disallow the one or more weights coupled to the one bar end to move relative to the bar.

* * * * *